US007396556B2

(12) United States Patent
Hayes

(10) Patent No.: US 7,396,556 B2
(45) Date of Patent: Jul. 8, 2008

(54) METHOD OF COATING A MEDICAL APPLIANCE UTILIZING VIBRATION

(75) Inventor: Micheál Hayes, Galway (IE)

(73) Assignee: Boston Scientific Scimed, Inc., Maple Grove, MN (US)

( * ) Notice: Subject to any disclaimer, the term of this patent is extended or adjusted under 35 U.S.C. 154(b) by 277 days.

(21) Appl. No.: 11/088,800

(22) Filed: Mar. 25, 2005

(65) Prior Publication Data

US 2006/0216403 A1 Sep. 28, 2006

(51) Int. Cl.

| | |
|---|---|
| ***B05D 7/00*** | (2006.01) |
| ***B05D 3/12*** | (2006.01) |
| ***B05C 11/08*** | (2006.01) |
| ***B05C 13/02*** | (2006.01) |

(52) U.S. Cl. ..... 427/2.1; 427/346; 118/56; 118/319; 118/320; 118/500

(58) Field of Classification Search ..... 427/2.1, 427/346; 118/56–57, 319, 320, 500
See application file for complete search history.

(56) References Cited

U.S. PATENT DOCUMENTS

| | | | | |
|---|---|---|---|---|
| 5,891,507 | A | 4/1999 | Jayaraman | |
| 6,156,373 | A | 12/2000 | Zhong et al. | |
| 6,395,326 | B1 | 5/2002 | Castro et al. | |
| 6,527,863 | B1 | 3/2003 | Pacetti et al. | |
| 6,723,373 | B1 | 4/2004 | Narayanan | |
| 6,743,462 | B1 | 6/2004 | Pacetti | |
| 2002/0127327 | A1 * | 9/2002 | Schwarz et al. | 427/2.15 |
| 2002/0169353 | A1 | 11/2002 | Chan et al. | |
| 2003/0099765 | A1 * | 5/2003 | Jayaraman | 427/2.24 |
| 2003/0207019 | A1 | 11/2003 | Shekalim et al. | |
| 2003/0215564 | A1 * | 11/2003 | Heller et al. | 427/2.25 |
| 2004/0013792 | A1 * | 1/2004 | Epstein et al. | 427/2.24 |
| 2006/0029720 | A1 | 2/2006 | Panos et al. | |
| 2006/0147611 | A1 * | 7/2006 | Coye et al. | 427/2.1 |

FOREIGN PATENT DOCUMENTS

| | | | |
|---|---|---|---|
| EP | 1 087 034 | A | 3/2001 |
| WO | WO 03/074196 | A | 9/2003 |
| WO | WO03074196 | A2 * | 9/2003 |
| WO | WO 2004/008995 | A | 1/2004 |

OTHER PUBLICATIONS

International Preliminary Report on Patentability in PCT/US2006/006428, dated Oct. 4, 2007.

* cited by examiner

*Primary Examiner*—William P. Fletcher, III
*Assistant Examiner*—Cachet I Sellman
(74) *Attorney, Agent, or Firm*—Kenyon & Kenyon LLP

(57) ABSTRACT

A method of coating a medical appliance is provided that includes vibrating the medical appliance and contacting a material with the medical appliance to form the coating. A medical appliance is provided having a coating applied by a method. The method includes vibrating the medical appliance and contacting a material with the medical appliance to form the coating. A system is provided for coating a medical appliance. The system includes an arrangement for holding the medical appliance and an arrangement for at least one of moving and rotating the arrangement for holding the medical appliance. The system also includes an arrangement for vibrating the medical appliance.

12 Claims, 3 Drawing Sheets

METHOD OF COATING A MEDICAL APPLIANCE UTILIZING VIBRATION

FIELD OF THE INVENTION

The present invention relates to medical appliances. More particularly, the present invention relates to a method of coating a medical appliance using vibration to reduce coating defects and control coating integrity, a system for vibrating a medical appliance, and a medical appliance produced by the method.

BACKGROUND INFORMATION

Medical devices may be coated so that the surfaces of such devices have desired properties or effects. For example, it may be useful to coat medical devices to provide for the localized delivery of therapeutic agents to target locations within the body, such as to treat localized disease (e.g., heart disease) or occluded body lumens. Localized drug delivery may avoid some of the problems of systemic drug administration, which may be accompanied by unwanted effects on parts of the body which are not to be treated. Additionally, treatment of the afflicted part of the body may require a high concentration of therapeutic agent that may not be achievable by systemic administration. Localized drug delivery may be achieved, for example, by coating balloon catheters, stents and the like with the therapeutic agent to be locally delivered. The coating on medical devices may provide for controlled release, which may include long-term or sustained release, of a bioactive material.

Aside from facilitating localized drug delivery, medical devices may be coated with materials to provide beneficial surface properties. For example, medical devices are often coated with radiopaque materials to allow for fluoroscopic visualization while placed in the body. It is also useful to coat certain devices to achieve enhanced biocompatibility and to improve surface properties such as lubriciousness.

Coated stent may be used to reduce restenosis rates in patients. Stents may be coated in a spraying process. For example, stents may be mounted into wire C-frames using stainless steel wire. The C-frame may then be mounted into a collet. The collet may be mounted into a shaft, and the shaft may be rotated, raised, and lowered across a spray plume.

Conventional coating methods may result in coating defects. Product specification for webbing may be restrictive, and only small webs may be allowable. For example, 70 μm web lengths may be cause for rejection. Some stents may be particularly prone to webbing of greater than 70 μm and protrusions of greater than 200 μm due to stent geometry (for example, the closeness of the struts).

Motor cars have been painted using vibrations to compensate for nozzle imperfections or other irregularities. Vibration may be imparted to the motor car during a spray painting operation by running the engine with one spark plug removed. The removed spark plug may induce vibration that may have the effect of smoothing the spray coating.

There is therefore a need for reducing coating defects in medical appliances.

Each of the references cited herein is incorporated by reference herein for background information.

DETAILED DESCRIPTION

Figure 1:
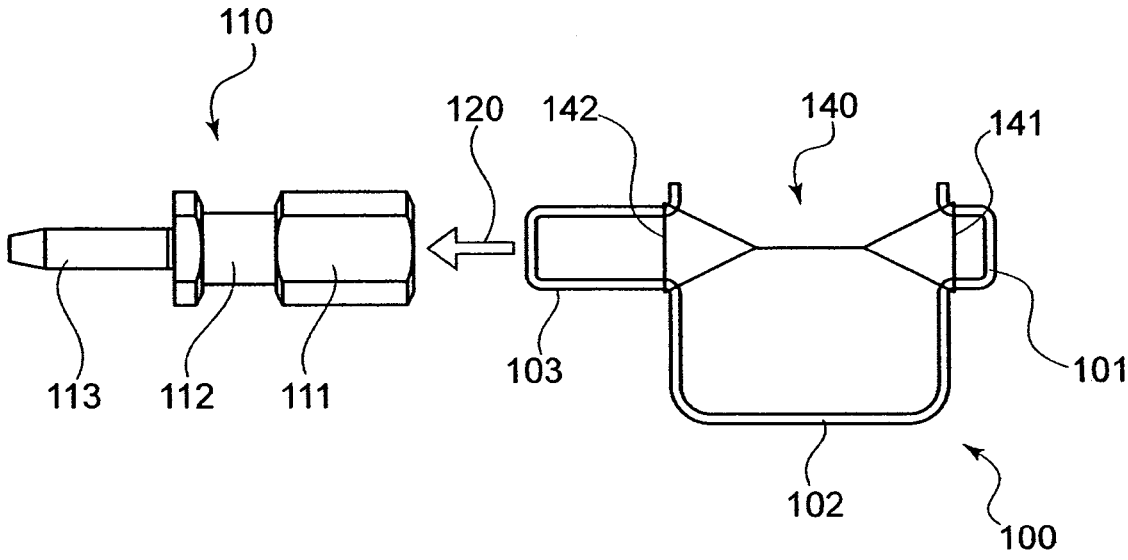
FIG. 1 shows a cross-wire fixture, a cross-wire, and a collet.

A method of coating a medical appliance is provided that includes vibrating the medical appliance and contacting a material with the medical appliance to form the coating.

The vibrating of the medical appliance may include directing a pressurized fluid at the medical appliance and/or an arrangement for holding the medical appliance. The vibrating of the medical appliance may include directing an ultrasonic nozzle at the medical appliance and/or an arrangement for holding the medical appliance. The vibrating of the medical appliance may include allowing a resonant frequency of an arrangement for positioning the medical appliance to propagate through an arrangement for holding the medical appliance. The vibrating of the medical appliance may include providing a camming arrangement adapted to induce a vibration during a moving and/or a rotating of an arrangement for positioning the medical appliance. The vibrating of the medical appliance may include enhancing a resonant frequency of an arrangement for positioning the medical appliance.

A fit between an arrangement for positioning the medical appliance and an arrangement for holding the medical appliance may be adapted to allow a vibration to propagate between the arrangement for positioning the medical appliance and the arrangement for holding the medical appliance.

The contacting of the coating with the medical appliance may include spraying the coating onto the medical appliance. The method may include moving and/or rotating the medical appliance and/or an arrangement for spraying the medical appliance. The medical appliance may be moved through a plume of the arrangement for spraying the medical appliance. The medical appliance may be moved vertically through the plume.

The vibrating of the medical appliance may be in a vertical direction and/or a horizontal direction. The medical appliance may be vibrated during and/or after the contacting of the coating. The medical appliance may be vibrated during a first part of the contacting of the coating and may not be vibrated during a second part of the contacting of the coating.

A medical appliance is provided having a coating applied by a method. The method includes vibrating the medical appliance and contacting a material with the medical appliance to form the coating.

A system is provided for coating a medical appliance. The system includes an arrangement for holding the medical appliance and an arrangement for moving and/or rotating the arrangement for holding the medical appliance. The system also includes an arrangement for vibrating the medical appliance.

The arrangement for holding the medical appliance may include a collet and a cross-wire fixture adapted to fit in the collet. The cross-wire fixture may be adapted to fit in the collet with a non-interference fit.

The arrangement for vibrating the medical appliance may include a spray nozzle, an ultrasonic nozzle, and/or a high-pressure gas nozzle.

The arrangement for vibrating the medical appliance may include a stepper motor adapted to impart a vibration to the arrangement for moving and/or rotating the arrangement for holding the medical appliance.

The arrangement for vibrating the medical appliance may include a camming arrangement adapted to impart a vibration to the arrangement for moving and/or rotating the arrangement for holding the medical appliance.

An exemplary embodiment of the present invention relates to a method of vibrating a medical appliance (for instance, a stent), during spraying as a means of controlling coating integrity and kinetic drug release. An exemplary embodiment of the present invention may reduce kinetic drug release variation, provide an even coating surface, reduce webbing, and reduce protrusions on the coated stent.

An exemplary embodiment of the present invention may offer a method of controlling kinetic drug release and/or coating defects (for example, coating defect units including webs and/or protrusions) in a coated stent.

An exemplary embodiment of the present invention may avoid changing current spraying process parameters, but may introduce a further parameter for control, namely a vibration rate.

The surface of a coated stent may appear both smooth and rippled. The rippled effect (also referred to as a "sand-dune effect") may correlate with kinetic drug release for the stent by increasing the number of bare spots during wet/dry spraying experiments.

A preferred state of the surface may be smooth with minimum variation in surface and a slower release rate for a bioactive agent. An exemplary embodiment of the present invention may use vibration to smooth-out the coating surface of the stent during spraying.

Vibration may be introduced during the coating process by any of several methods. One method for introducing vibration involves connecting an ultrasonic generator to the stent drive shaft to transmit vibrations to the collet, which communicates the vibrations to the C-frame, onto the stent wire, and finally to the stent.

Another method of vibrating a medical appliance during a coating process involves increasing a nitrogen gas "kick-effect" vibration. Conventionally, a collet shaft is a non-interference fit in the spray machine shaft. As the stent rotates, the C-frame "kick vibrates" when the nitrogen gas hits the C-frame once during each stent rotation. A tight fitting collet/shaft combination may increase a webbing effect. Therefore, by increasing the number of stent kicks, the stent may vibrate more, the webbing effect may be reduced, and the coating may become smoother. This result may also be achieved by changing the frame. An O-type frame may induce two kicks and a box-type frame may induce four kicks. Other frame designs may be used or modified to induce the desired number of kicks during the coating process. Since these alternative frames have sections that pass through the spray nozzle, the number of kicks per cycle may be increased or decreased depending on the desired vibration characteristic.

Another method of vibrating a medical appliance during a coating process involves modifying a stent-mounting shaft. For instance, this may be achieved by introducing a cam design to vibrate the stent as the shaft rotates. Multiple cams may allow a specific desired vibration frequency to be generated. These cams may introduce a vertical vibration, a horizontal vibration, or any combination of vibrations.

Another method of vibrating a medical appliance during a coating process involves resonance vibration. In this situation, a machine is induced to vibrate naturally and generate its own resonance vibration by removing anti-vibration feet pads.

Another method of vibrating a medical appliance during a coating process involves using methods other than mechanical methods to induce vibration. For instance, it may be possible to induce vibration without contacting the stent assembly by creating ultrasonic air vibrations.

Additionally, vibrations from an ultrasonic generator, a cam, a stepper motor, or a pressure nozzle kick may be controllable and may be adjusted to modify kinetic drug release and coating integrity. For instance multiple nozzles may be introduced or may be activated and/or deactivated as desired to create a variable vibration rate and/or to create a vibration rate while one part of the medical appliance is being coated and to reduce and/or eliminate a vibration rate while another part of the medical appliance is being coated.

Alternative exemplary embodiments may be utilized alternatively or additionally to reduce coating defects. By moving the stent wire and the stent relative to each other, the wire may slide up and down the four stent contact points during spraying. This sliding may spread out the coating on the wire and thereby reduce the effect of wire to stent contact point protrusion and webbing.

Fine vibration may smooth out the coating and ensure consistent coating integrity that may be desirable in the control of kinetic drug release. Coating defects like webbing, protrusions, and bare spots may thereby be avoided.

Additionally and/or alternatively, vibration sensors may be used in the machine to monitor and control noise and/or inherent vibration. Some or all of these anti-vibration measures may be reduced and/or eliminated in order to induce the desired vibration during the coating operation.

Stepper motor drives may be used for stent shaft rotation to increase a vibration effect. The amount of smoothing, and therefore the kinetic drug release, may be adjusted by adjusting a timing of a vibration, a frequency of the vibration, and an amplitude of the vibration in the medical appliance.

An exemplary method may be used to tailor a drug design to control kinetic drug release so that each layer may have a controlled kinetic drug release. The method may be tailored by applying a variety of vibration levels for each coating layer.

As a further embodiment of the invention, a variety of kinetic drug release rates may be applied to a particular position on the stent. For example, it may be desired for the patient that there be a different release rate in the center of a lesion or at the end of the lesion (or at the center or end of the stent). An exemplary method may allow for the possibility of different kinetic drug release across the stent length and at different positions whatever the product application may require.

FIG. 1 shows cross-wire fixture 100 and collet 110. Cross-wire fixture 100 includes end loop C frame 101, long C frame 102, and collet fixture C frame 103. Looped over end loop C frame 101 and collet fixture C frame 103 is cross-wire 140, which includes end loop of cross-wire 141 and collet-side loop of cross-wire 142. Specifically end loop of cross-wire 141 loops over end loop C frame 101, while collet-side loop of cross-wire 142 loops over collet fixture C frame 103. The central section of cross-wire 140 extends between end loop C frame 101 and collet fixture C frame 103 and is taut to promote the transmission of vibration.

Collet 110 of FIG. 1 includes frame fixture fitting 111, pick and place interface 112, and stem shaft 113. During the fixturing process, after the stent is placed on cross-wire 140, cross-wire fixture 100 is inserted in collet 110 by moving it in the direction of arrow 120.

Figure 2:
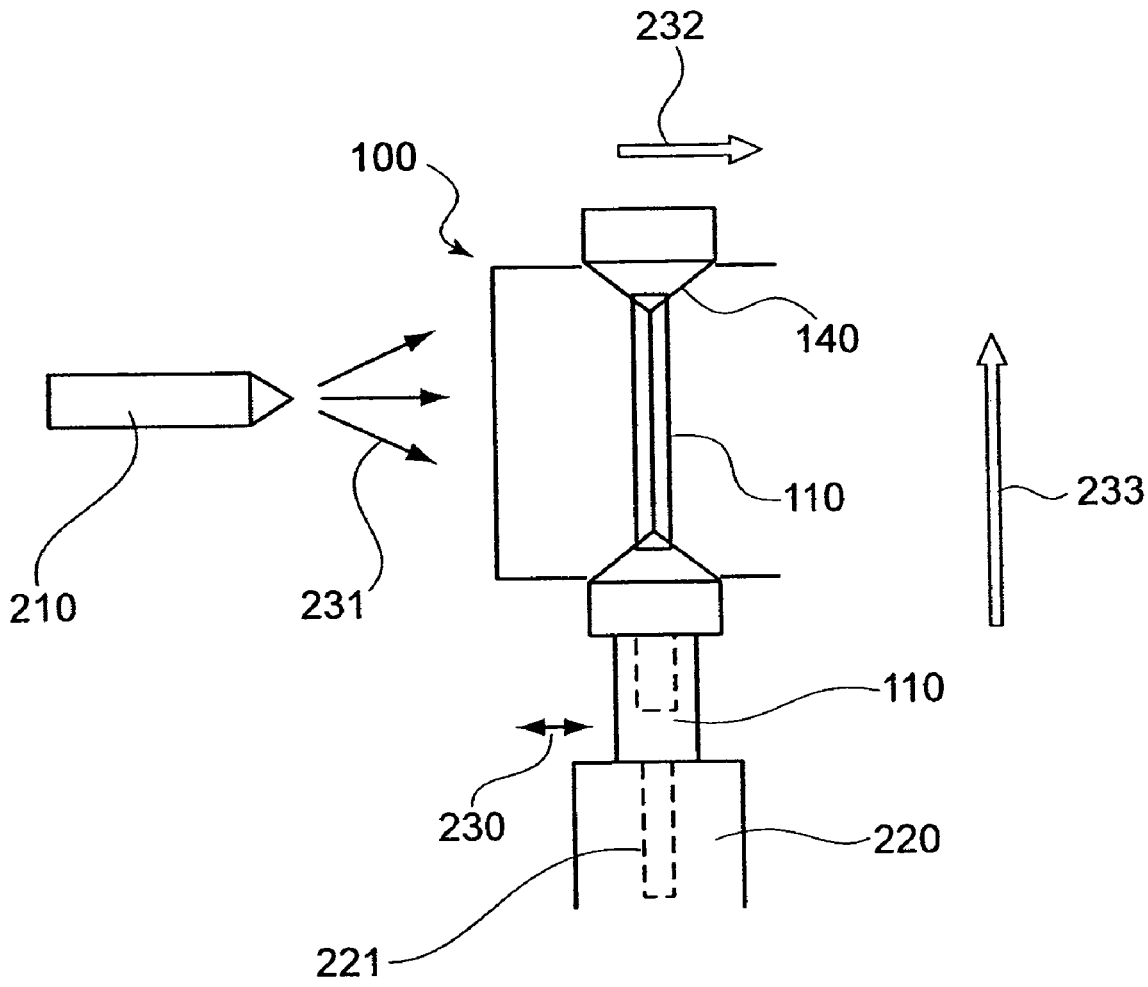
FIG. 2 is a schematic cross-sectional representation of an exemplary embodiment of the present invention showing a stent mounted on a cross-wire and showing a spray nozzle and spray plume.

FIG. 2 is a schematic cross-sectional representation of an exemplary embodiment of the present invention showing stent 200 mounted on cross-wire 140 and showing spray nozzle 210 and spray plume 231. Cross-wire fixture 100 having cross-wire 140 and holding stent 200 is shown mounted on collet 110. Collet 110 mounts in machine 220 in machine shaft 221. The fit for collet 110 in machine shaft 221 may be an interference fit that might promote the propagation of vibrations from machine 220 up collet 110 onto cross-wire fixture 100, onto cross-wire 140, and onto stent 200. Alternatively, the fit for collet 110 in machine shaft 221 may be a non-interference fit that would allow collet 110 to vibrate in place in response to an external force, for instance spray plume 231 ejected from nozzle 210. A non-interference fit may allow motion of collet 110 in the direction of two-sided arrow 230. Machine 220 may be adapted to move and rotate collet 110 through spray plume 231. Spray plume 231 may contact cross-wire fixture 100 on each revolution of machine 220 and collet 110 and may provide a kick to the combination of collet 110 and cross-wire fixture 100 to create a vibration that may be communicated to cross-wire 140 and stent 200. This kick may be in the direction of arrow 232. Additional nozzles 210 may be provided, and may be oriented around a circumference of the path of travel of machine 220. Additionally, nozzles 210 may be oriented to kick cross-wire fixture in any other direction, including a vertical direction illustrated by arrow 233. Nozzles 210 may eject coating and another fluid (for instance, air or nitrogen gas), or may eject only inert fluids to provide the kick effect. Nozzles 210 may be mounted on machine 220 and thereby move and travel with machine 220 as it moves and rotates through spray plume 231. Nozzles 210 also may spray continuously or intermittently to provide a kick during specific times in which specific regions of stent 200 are being coated.

Figure 3:
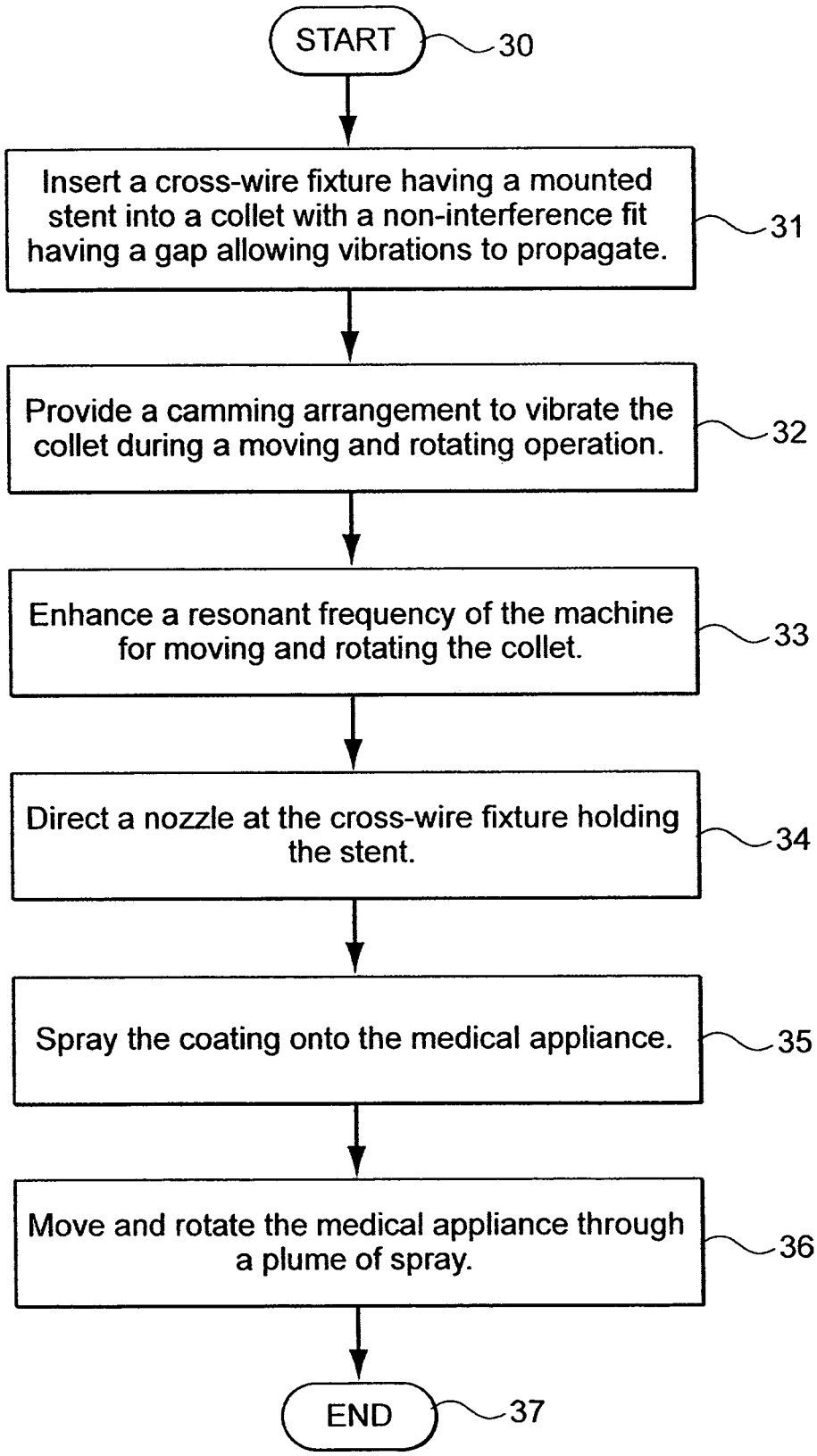
FIG. 3 is a flow chart illustrating an exemplary method for manufacturing an exemplary embodiment of the present invention.

FIG. 3 is a flow chart illustrating an exemplary method for manufacturing an exemplary embodiment of the present invention. The flow in FIG. 3 starts in start circle 30 and proceeds to action 31, which indicates to insert a cross-wire fixture having a mounted stent into a collet. The cross-wire fixture mounts in the collet with a non-interference fit having a gap allowing vibrations to propagate. From action 31, the flow proceeds to action 32, which indicates to provide a camming arrangement to vibrate the collet during a moving and rotating operation. From action 32, the flow proceeds to action 33, which indicates to enhance a resonant frequency of the machine for moving and rotating the collet. From action 33, the flow proceeds to action 34, which indicates to direct a nozzle at the cross-wire fixture holding the stent. From action 34, the flow proceeds to action 35, which indicates to spray the coating onto the medical appliance. From action 35, the flow proceeds to action 36, which indicates to move and rotate the medical appliance through a plume of spray. From action 36, the flow proceeds to end circle 37.

As used herein, the term "therapeutic agent" includes one or more "therapeutic agents" or "drugs". The terms "therapeutic agents", "active substance" and "drugs" are used interchangeably herein and include pharmaceutically active compounds, nucleic acids with and without carrier vectors (such as lipids), compacting agents (such as histones), viruses (such as adenovirus, adeno-associated virus, retrovirus, lentivirus and α-virus), polymers, hyaluronic acid, proteins, cells and the like, with or without targeting sequences.

The therapeutic agent may be any pharmaceutically acceptable agent such as a non-genetic therapeutic agent, a biomolecule, a small molecule, or cells.

Exemplary non-genetic therapeutic agents include antithrombogenic agents such as heparin, heparin derivatives, prostaglandin (including micellar prostaglandin E1), urokinase, and PPack (dextrophenylalanine proline arginine chloromethyl ketone); antiproliferative agents such as enoxaparin, angiopeptin, sirolimus (rapamycin), tacrolimus, everolimus, monoclonal antibodies capable of blocking smooth muscle cell proliferation, hirudin, and acetylsalicylic acid; anti-inflammatory agents such as dexamethasone, rosiglitazone, prednisolone, corticosterone, budesonide, estrogen, estradiol, sulfasalazine, acetylsalicylic acid, mycophenolic acid, and mesalamine; antineoplastic/antiproliferative/antimitotic agents such as paclitaxel, epothilone, cladribine, 5-fluorouracil, methotrexate, doxorubicin, daunorubicin, cyclosporine, cisplatin, vinblastine, vincristine, endostatin, trapidil, halofuginone, and angiostatin; anticancer agents such as antisense inhibitors of c-myc oncogene; antimicrobial agents such as triclosan, cephalosporins, aminoglycosides, nitrofurantoin, silver ions, compounds, or salts; biofilm synthesis inhibitors such as non-steroidal anti-inflammatory agents and chelating agents such as ethylenediaminetetraacetic acid, O,O'-bis(2-aminoethyl)ethyleneglycol-N,N,N',N'-tetraacetic acid and mixtures thereof; antibiotics such as gentamicin, rifampin, minocycline, and ciprofloxacin; antibodies including chimeric antibodies and antibody fragments; anesthetic agents such as lidocaine, bupivacaine, and ropivacaine; nitric oxide; nitric oxide (NO) donors such as linsidomine, molsidomine, L-arginine, NO-carbohydrate adducts, polymeric or oligomeric NO adducts; anticoagulants such as D-Phe-Pro-Arg chloromethyl ketone, an RGD peptide-containing compound, heparin, antithrombin compounds, platelet receptor antagonists, antithrombin antibodies, antiplatelet receptor antibodies, enoxaparin, hirudin, warfarin sodium, dicumarol, aspirin, prostaglandin inhibitors, platelet aggregation inhibitors such as cilostazol and tick antiplatelet factors; vascular cell growth promoters such as growth factors, transcriptional activators, and translational promoters; vascular cell growth inhibitors such as growth factor inhibitors, growth factor receptor antagonists, transcriptional repressors, translational repressors, replication inhibitors, inhibitory antibodies, antibodies directed against growth factors, bifunctional molecules consisting of a growth factor and a cytotoxin, bifunctional molecules consisting of an antibody and a cytotoxin; cholesterol-lowering agents; vasodilating agents; agents which interfere with endogenous vasoactive mechanisms; inhibitors of heat shock proteins such as geldanamycin; and any combinations and prodrugs of the above.

Exemplary biomolecules include peptides, polypeptides and proteins; oligonucleotides; nucleic acids such as double or single stranded DNA (including naked and cDNA), RNA, antisense nucleic acids such as antisense DNA and RNA, small interfering RNA (siRNA), and ribozymes; genes; carbohydrates; angiogenic factors including growth factors; cell cycle inhibitors; and antirestenosis agents. Nucleic acids may be incorporated into delivery systems such as, for example, vectors (including viral vectors), plasmids or liposomes.

Non-limiting examples of proteins include monocyte chemoattractant proteins ("MCP-1") and bone morphogenic proteins ("BMPs"), such as, for example, BMP-2, BMLP-3, BMP-4, BMP-5, BMP-6 (Vgr-1), BMP-7 (OP-1), BMP-8, BMP-9, BMP-10, BMP-11, BMP-12, BMP-13, BMP-14, BMP-15. Preferred BMPS are any of BMP-2, BMP-3, BMP-4, BMP-5, BMP-6, and BMP-7. These BMPs can be provided as homodimers, heterodimers, or combinations thereof, alone or together with other molecules. Alternatively, or in addition, molecules capable of inducing an upstream or downstream effect of a BMP can be provided. Such molecules include any of the "hedgehog" proteins, or the DNA encoding them. Non-limiting examples of genes include survival genes that protect against cell death, such as anti-apoptotic Bcl-2 family factors and Akt kinase and combinations thereof. Non-limiting examples of angiogenic factors include acidic and basic fibroblast growth factors, vascular endothelial growth factor, epidermal growth factor, transforming growth factor α and β, platelet-derived endothelial growth factor, platelet-derived growth factor, tumor necrosis factor α, hepatocyte growth factor, and insulin-like growth factor. A non-limiting example of a cell cycle inhibitor is a cathepsin D (CD) inhibitor. Non-limiting examples of antirestenosis agents include p15, p16, p18, p19, p21, p27, p53, p57, Rb, nFkB and E2F decoys, thymidine kinase ("TK") and combinations thereof and other agents useful for interfering with cell proliferation.

Exemplary small molecules include hormones, nucleotides, amino acids, sugars, and lipids and compounds that have a molecular weight of less than 100 kD.

Exemplary cells include stem cells, progenitor cells, endothelial cells, adult cardiomyocytes, and smooth muscle cells. Cells can be of human origin (autologous or allogeneic) or from an animal source (xenogeneic), or genetically engineered. Non-limiting examples of cells include side population (SP) cells, lineage negative (Lin-) cells including Lin-CD34−, Lin-CD34+, Lin-c Kit+, mesenchymal stem cells including mesenchymal stem cells with 5-aza, cord blood cells, cardiac or other tissue derived stem cells, whole bone marrow, bone marrow mononuclear cells, endothelial progenitor cells, skeletal myoblasts or satellite cells, muscle derived cells, G0 cells, endothelial cells, adult cardiomyocytes, fibroblasts, smooth muscle cells, adult cardiac fibroblasts+5-aza, genetically modified cells, tissue engineered grafts, MyoD scar fibroblasts, pacing cells, embryonic stem cell clones, embryonic stem cells, fetal or neonatal cells, immunologically masked cells, and teratoma derived cells.

Any of the therapeutic agents may be combined to the extent such combination is biologically compatible.

Any of the above mentioned therapeutic agents may be incorporated into a polymeric coating on the medical device or applied onto a polymeric coating on a medical device. The polymers of the polymeric coatings may be biodegradable or non-biodegradable. Non-limiting examples of suitable non-biodegradable polymers include polystyrene polyisobutylene copolymers and styrene-isobutylene-styrene block copolymers such as styrene-isobutylene-styrene tert-block copolymers (SIBS); polyvinylpyrrolidone including cross-linked polyvinylpyrrolidone; polyvinyl alcohols, copolymers of vinyl monomers such as EVA; polyvinyl ethers; polyvinyl aromatics; polyethylene oxides; polyesters including polyethylene terephthalate; polyamides; polyacrylamides; polyethers including polyethersulfone; polyalkylenes including polypropylene, polyethylene and high molecular weight polyethylene; polyurethanes; polycarbonates, silicones; siloxane polymers; cellulosic polymers such as cellulose acetate; polymer dispersions such as polyurethane dispersions (BAYHYDROL®); squalene emulsions; and mixtures and copolymers of any of the foregoing.

Non-limiting examples of suitable biodegradable polymers include polycarboxylic acid, polyanhydrides including maleic anhydride polymers; polyorthoesters; poly-amino acids; polyethylene oxide; polyphosphazenes; polylactic acid, polyglycolic acid and copolymers and mixtures thereof such as poly(L-lactic acid) (PLLA), poly(D,L-lactide) poly (lactic acid-co-glycolic acid), 50/50 (DL-lactide-co-glycolide); polydioxanone; polypropylene fumarate; polydepsipeptides; polycaprolactone and co-polymers and mixtures thereof such as poly(D,L-lactide-co-caprolactone) and polycaprolactone co-butyl acrylate; polyhydroxybutyrate valerate and blends; polycarbonates such as tyrosine-derived polycarbonates and acrylates, polyiminocarbonates, and polydimethyltrimethylcarbonates; cyanoacrylate; calcium phosphates; polyglycosaminoglycans; macromolecules such as polysaccharides (including hyaluronic acid; cellulose, and hydroxypropyl methyl cellulose; gelatin; starches; dextrans; alginates and derivatives thereof), proteins and polypeptides; and mixtures and copolymers of any of the foregoing. The biodegradable polymer may also be a surface erodible polymer such as polyhydroxybutyrate and its copolymers, polycaprolactone, polyanhydrides (both crystalline and amorphous), maleic anhydride copolymers, and zinc calcium phosphate.

Such coatings used with the present invention may be formed by any method known to one in the art. For example, an initial polymer/solvent mixture can be formed and then the therapeutic agent added to the polymer/solvent mixture. Alternatively, the polymer, solvent, and therapeutic agent can be added simultaneously to form the mixture. The polymer/solvent/therapeutic agent mixture may be a dispersion, suspension or a solution. The therapeutic agent may also be mixed with the polymer in the absence of a solvent. The therapeutic agent may be dissolved in the polymer/solvent mixture or in the polymer to be in a true solution with the mixture or polymer, dispersed into fine or micronized particles in the mixture or polymer, suspended in the mixture or polymer based on its solubility profile, or combined with micelle-forming compounds such as surfactants or adsorbed onto small carrier particles to create a suspension in the mixture or polymer. The coating may comprise multiple polymers and/or multiple therapeutic agents.

The coating can be applied to the medical device by any known method in the art including dipping, spraying, rolling, brushing, electrostatic plating or spinning, vapor deposition, air spraying including atomized spray coating, and spray coating using an ultrasonic nozzle.

The coating is typically from about 1 to about 50 microns thick. In the case of balloon catheters, the thickness is preferably from about 1 to about 10 microns, and more preferably from about 2 to about 5 microns. Very thin polymer coatings, such as about 0.2-0.3 microns and much thicker coatings, such as more than 10 microns, are also possible. It is also within the scope of the present invention to apply multiple layers of polymer coatings onto the medical device. Such multiple layers may contain the same or different therapeutic agents and/or the same or different polymers. Methods of choosing the type, thickness and other properties of the polymer and/or therapeutic agent to create different release kinetics are well known to one in the art.

The medical device may also contain a radio-opacifying agent within its structure to facilitate viewing the medical device during insertion and at any point while the device is implanted. Non-limiting examples of radio-opacifying agents are bismuth subcarbonate, bismuth oxychloride, bismuth trioxide, barium sulfate, tungsten, and mixtures thereof.

Non-limiting examples of medical devices according to the present invention include catheters, guide wires, balloons, filters (e.g., vena cava filters), stents, stent grafts, vascular grafts, intraluminal paving systems, implants and other devices used in connection with drug-loaded polymer coatings. Such medical devices may be implanted or otherwise utilized in body lumina and organs such as the coronary vasculature, esophagus, trachea, colon, biliary tract, urinary tract, prostate, brain, lung, liver, heart, skeletal muscle, kidney, bladder, intestines, stomach, pancreas, ovary, cartilage, eye, bone, and the like.

While the present invention has been described in connection with the foregoing representative embodiment, it should be readily apparent to those of ordinary skill in the art that the representative embodiment is exemplary in nature and is not to be construed as limiting the scope of protection for the invention as set forth in the appended claims.

What is claimed is:

1. A method of coating a medical appliance, comprising:

vibrating the medical appliance; and contacting a material with the medical appliance to form the coating;

wherein the vibrating of the medical appliance further comprises providing a camming arrangement adapted to induce a vibration during at least one of a moving and a rotating of an arrangement for positioning the medical appliance.

2. The method of claim 1, wherein a fit between an arrangement for positioning the medical appliance and an arrangement for holding the medical appliance is adapted to allow a vibration to propagate between the arrangement for positioning the medical appliance and the arrangement for holding the medical appliance.

3. The method of claim 1, wherein the contacting of the coating with the medical appliance further comprises spraying the coating onto the medical appliance.

4. The method of claim 1, wherein the medical appliance is moved through a plume of at least one arrangement for spraying the medical appliance.

5. The method of claim 4, wherein the medical appliance is moved vertically through the plume.

6. The method of claim 1, wherein the medical appliance is vibrated at least one of during and after the contacting of the coating.

7. The method of claim 1, further comprising determining at least one of an amplitude and a frequency for the vibrating operation.

8. A method of coating a medical device, comprising:

mounting the medical device on a wire held by a fixture, the fixture comprising a frame;

rotating the frame and thereby rotating the medical device;

directing a pressurized fluid at the frame as the frame rotates, causing a portion of the frame to pass through the pressurized fluid on each revolution of the frame, thereby inducing a vibration in the fixture, the wire, and the medical device; and contacting a coating material with the medical device while the medical device is rotated and vibrating, thereby forming a coating on the medical device.

9. The method of claim 8, wherein the fixture is coupled with a collet with a non-interference fit to allow a vibration to propagate between the fixture and the collet.

10. The method of claim 8, wherein the contacting of the coating material with the medical device comprises spraying the coating material onto the medical device.

11. A method of coating a medical device, comprising:

holding a medical device by a fixture, the fixture comprising a frame;

coupling the fixture to a collet with a non-interference fit between the fixture and the collet to allow a vibration to propagate between the fixture and the collet, thereby inducing a vibration in the fixture and the medical device; and contacting a coating material with the medical device while the medical device is vibrating, thereby forming a coating on the medical device.

12. The method of claim 11, wherein the contacting of the coating material with the medical device comprises spraying the coating material onto the medical device.

* * * * *